US005095546A

United States Patent [19]

Jones

[11] Patent Number: 5,095,546

[45] Date of Patent: Mar. 17, 1992

[54] NECKTIE RESTRAINT

[76] Inventor: Jerry R. Jones, 2501 Copper Creek La., Carrollton, Tex. 75006

[21] Appl. No.: 473,322

[22] Filed: Feb. 1, 1990

Related U.S. Application Data

[63] Continuation-in-part of Ser. No. 279,806, Dec. 5, 1988, abandoned.

[51] Int. Cl.[5] ..... A41D 25/00

[52] U.S. Cl. ..... 2/145; 2/144; 2/156

[58] Field of Search ..... 2/144, 145, 157

[56] References Cited

U.S. PATENT DOCUMENTS 1,291,090 1/1919 Nuzum ..... 2/157 X
1,764,705 6/1930 Ward ..... 2/145
2,006,427 7/1935 Wolfson ..... 2/145
4,827,576 5/1989 Prince, Jr. ..... 2/145 X

FOREIGN PATENT DOCUMENTS 158526 4/1954 Australia ..... 2/145

*Primary Examiner*—Werner H. Schroeder
*Assistant Examiner*—Jeanette Chapman
*Attorney, Agent, or Firm*—Daniel V. Thompson

[57] ABSTRACT

An apparatus for restraining a necktie to a shirt front. The apparatus includes a longitudinal strip of material on the wide underside portion of the necktie, stitched in place, and surrounded by a horizontal transverse loop containing a buttonhole for attachment to a shirt front button.

2 Claims, 2 Drawing Sheets

NECKTIE RESTRAINT

CROSS REFERENCE TO RELATED APPLICATION

This is a continuation in part of my patent application Ser. No. 07/279,806 filed Dec. 5, 1988, now abandoned.

FIELD OF INVENTION

This invention relates to a device by which a necktie is secured to a shirt front thus avoiding any evidence of bulkiness or disarray.

DESCRIPTION OF THE INVENTION

Over the years various devices have been available so that the necktie wearer can be assured of having his tie remain securely in place. The trend towards such devices has offered improvements in ensuing years, but there is still substantial room for further advancements in such devices.

Whereas neckties themselves have evolved from heavier materials to more synthetic blends, advances in manufacture of more traditional necktie fabrics such as silk and cotton has magnified the need for a more accessible necktie restraint.

Neckties when worn underneath a suit jacket tend to become wrinkled with constant body movement causing the necktie itself to shift positions and an unsightly bulkiness to develop. On the other hand, when the suit jacket is removed, the necktie has a tendency to constantly change position in relation to the movement of the wearer. Such movement causes a constant shifting of the necktie's position and results in an untidy appearance.

Several necktie restraint devices are known in the art. U.S. Pat. No. 1,751,963 to Weinschreider discloses a plurality of cross strips which contain snap fasteners, such device being connected by elongated strips throughout the length of the tie. A plurality of buttonholes provide means for fastening the tie to the shirt front. U.S. Pat. No. 2,738,513 to Carty discloses a loop that attaches itself to a button on the shirt front for means of securing it in place. U.S. Pat. No. 2,749,553 to Miller discloses various means by which a vertical strip containing buttonholes may be stitched to the necktie for use as a restraint. U.S. Pat. No. 2,006,427 to Wolfson discloses a loop in combination with the manufacturer's label which must be permanently secured to the tie. U.S. Pat. No. 2,588,576 to Roop, et al., discloses an attachment which must be pressed into place with an iron using an adhesive, thus securing itself permanently to the tie. U.S. Pat. No. 1,434,797 to Shannon discloses an elongated loop or pocket with a plurality of buttonholes. This loop or pocket must be stitched into place on the tie. U.S. Pat. No. 2,481,367 to Thompson discloses a liner containing buttonholes which may zippered into place. A slider is provided for attachment to a strap which is stitched into place on the underside of the tie.

U.S. Pat. No. 1,764,705 to Ward discloses a necktie holder wherein a metal loop link 18 slides longitudinally on member 12. The metal loop link is not sized to receive the narrow end portion 10 of the tie, such that a separate strip 11 is required for restraining the narrow end portion of the tie.

SUMMARY OF THE INVENTION

The present invention provides a permanent device for securing a necktie in place by means of a simple, easy-to-attach longitudinal member having a slidable transverse member with a buttonhole for attachment to the shirt front. A preferred embodiment of the invention includes a longitudinal member formed integrally with the fabric of the tie, such that a smooth transition between the back surface of the tie and the longitudinal member is assured.

BRIEF DESCRIPTION OF THE DRAWINGS

A more complete understanding of the invention and its advantages will be apparent from the Detailed Description taken in conjunction with the drawings in which.

DETAILED DESCRIPTION OF THE PREFERRED EMBODIMENT

Figure 1:
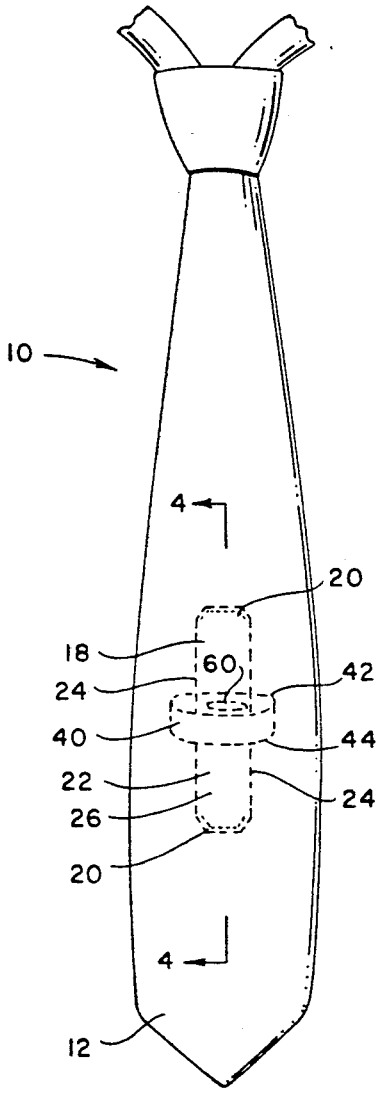
FIG. 1 is a front view of a necktie to which a restraint of the present invention is fixed.
Figure 2:
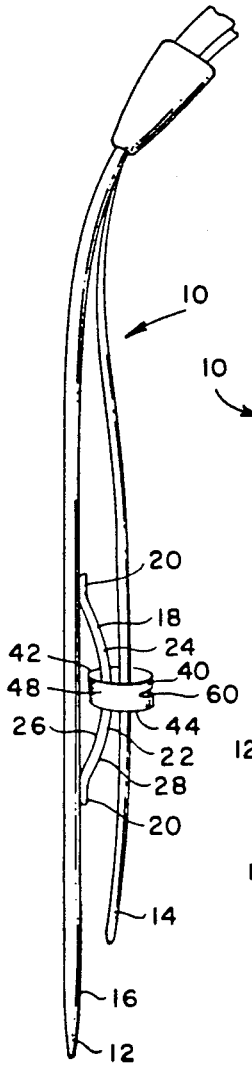
FIG. 2 is a side view of the necktie of FIG. 1.
Figure 3:
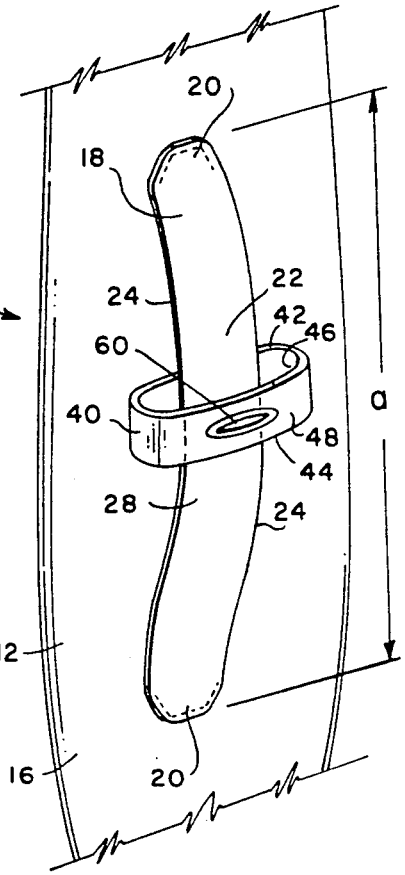
FIG. 3 is a fragmentary perspective view of the necktie restraint of the present invention.

Referring initially to FIGS. 1, 2 and 3, necktie 10 includes a wide end portion 12 and a narrow end portion 14. Wide end portion 12 includes an underside 16, to which a fabric longitudinal member 18 is stitched. Specifically, longitudinal member 18 has a length "a" (FIG. 3) of about four inches between two rounded ends 20 stitched to underside 16 of wide end portion 12. A central portion 22 has parallel sides 24 and inner and outer flat surfaces 26 and 28, respectively.

A fabric transverse member 40 is engaged for longitudinal sliding movements with the central portion 22 of longitudinal member 12. Transverse member 40 is preferably a loop having upper and lower parallel sides 42 and 44, respectively, and inner and outer surfaces 46 and 48, respectively. The longitudinal travel of transverse member 40 is defined by stitched rounded ends 20 of longitudinal member 18. Inner surface 46 of transverse member 40 faces the inner and outer surfaces 26 and 28, respectively, of longitudinal member 18. Outer surface 48 of transverse member 40 faces underside 16 of necktie wide end portion 12 on one side.

A buttonhole 60 is formed through transverse member 40 in a central location thereof.

Figure 4:
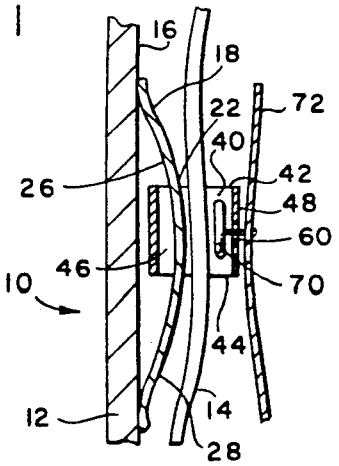
FIG. 4 is a vertical sectional view taken along lines 4—4 of FIG. 1.

In operation, the wearer ties the necktie in normal fashion, thereby establishing the relative positioning of wide end portion 12 and narrow end portion 14 with respect to each other. It will be understood that necktie 10 can be tied in an infinite number of configurations resulting in wide variances in the relative positioning of the wide and narrow end portions. Once the necktie is tied, narrow end portion 14 is inserted and passed through transverse member 40. Then, transverse member 40 can be longitudinally slid to a position where buttonhole 60 is adjacent a button 70 (FIG. 4) of shirt 72. Buttonhole 60 is engaged with button 70 in conventional fashion, thereby serving to restrain necktie 10 with respect to shirt 72. In preferred form, dimension "a" is about four inches, which corresponds to the typical button spacing for men's shirts.

It can thus be seen that the present invention provides a necktie restraint which is infinitely adjustable to suit any positioning of the tie and shirt buttons. In addition, the necktie is closely restrained to the shirt.

Referring now to FIGS. 5 through 8, fabric 100 includes a wide end portion 102 as shown. The remaining portion of fabric 100 is omitted from FIG. 5 for clarity. In conventional fashion, fabric 100 will be folded along longitudinal roll lines 104 and 106 and end roll lines 108 and 110 to form a necktie. Edges 112 and 114 will be basted together to form the center portions of the underside of the wide and narrow end portions of the necktie.

Figure 5:
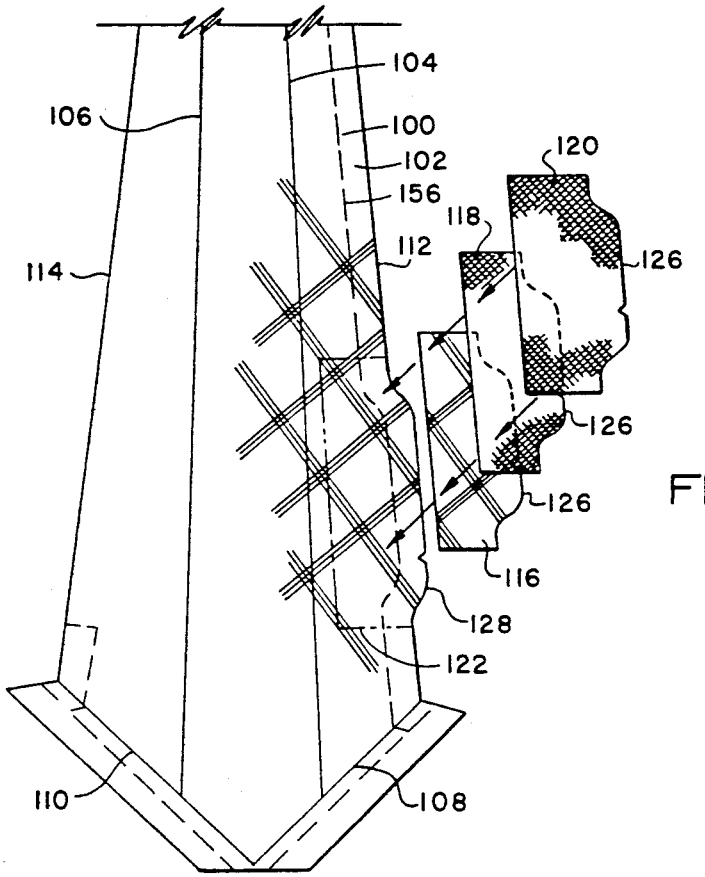
FIG. 5 is a schematic view of tie fabric pieces illustrating the preferred construction of the longitudinal member.
Figure 6:
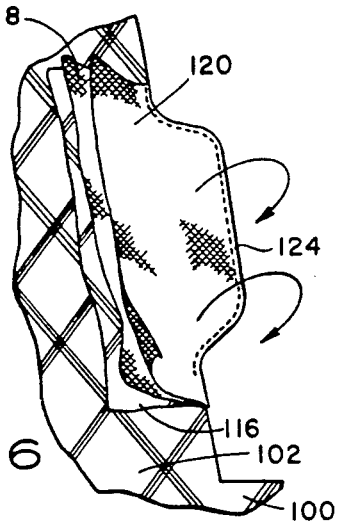
FIGS. 6, 7 and 8 illustrate subsequent steps in the construction of the longitudinal member.
Figure 7:
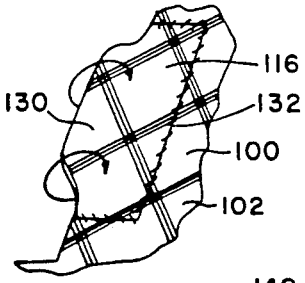
Figure 8:
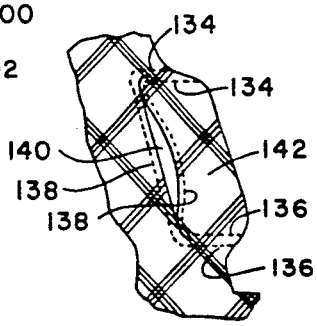

As an initial step, slit facing 116 and two interfacing pieces 118 and 120 are overlaid on a portion of fabric 100 illustrated by dotted line 122 in FIG. 5. Next, as shown in FIG. 6, slit facing 116 and interfacings 118 and 120 are stitched to fabric 100 along seam 124. Slit facings 116 and interfacings 118 and 120 have a centrally extending center portion 126 which is congruent with a similarly shaped center portion 128 of edge 112. Once seam 124 is in place, pieces 116, 118 and 120 are rolled as shown in the arrows in FIGS. 6 and 7 such that an extended edge 130 is formed having necktie fabric material on both sides and the interfacing pieces within. The free edge 132 of slit facing 116 is basted to fabric 100, as shown in FIG. 7. The next step, as shown in FIG. 8, involves using a narrow zigzag or buttonhole stitch to stitch upper and lower lateral reinforcing lines 134 and 136, respectively, and longitudinal reinforcing lines 138 into fabric plies 100, 116, 118 and 120. Longitudinal reinforcing lines 138 are then separated to form a slit 140 through fabric plies 100, 116, 118 and 120, thereby completing the construction of the longitudinal member 142.

Figure 9:
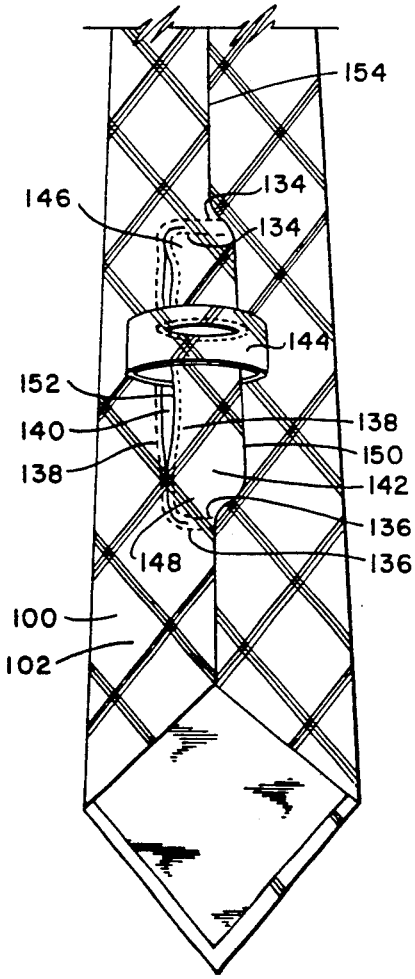
FIG. 9 illustrates the underside of the wide end portion constructed as shown in FIGS. 5–8.

As shown in FIG. 9, transverse member 144 is engaged for longitudinal sliding movements with longitudinal member 142. Longitudinal member 142 is formed from an integral portion of the wide end portion of the necktie. Longitudinal member 142 has two ends 146 and 148 and substantially parallel first and second sides 150 and 152, respectively. First side 150 is contiguous with central edge 154 formed when fabric 100 is folded along line 156 (FIG. 5). Second side 152 is formed from the incision 140 between longitudinal reinforcing lines 138. Second side 152 is spaced laterally from the edge 154 and first side 150.

Whereas the present invention has been described with respect to specific embodiments thereof, it will be understood that various changes and modifications will be suggested to one skilled in the art, and it is intended to encompass such changes and modifications as fall within the scope of the appended claims.

I claim:

1. A necktie, comprising:

a wide end portion having an underside;

a narrow end portion;

restraint means for anchoring said wide and narrow end portions to a shirt having buttons; and said restraint means including a fabric longitudinal member formed on said underside of said wide end portion having two ends and a central portion, said central portion of said longitudinal portion having substantially parallel first and second sides and inner and outer flat surfaces;

said longitudinal member being formed from an integral portion of said wide end portion, with said first side being contiguous with a central edge of said wide end portion underside, said central edge running substantially along a center portion of said wide end portion underside, and second side being formed from an incision through said wide end portion laterally spaced from said central edge;

a transverse member engaged for longitudinal sliding movements with said central portion of said longitudinal member; and button engaging means for releasably engaging said transverse member and a button of said shirt.

2. A necktie, comprising:

a wide end portion having an underside with a central edge;

a narrow end portion;

said wide and narrow end portions being formed of fabric tie material;

restraint means for anchoring said wide and narrow end portions to a shirt having buttons; and said restraint means including a fabric longitudinal member formed on said underside of said wide end portion having two ends and a central portion, said central portion of said longitudinal portion having substantially parallel first and second sides and inner and outer flat surfaces;

said longitudinal member being formed from an integral portion of said wide end portion on said outer flat surface and formed with a slit facing of said fabric tie material on said inner flat surface, with said first side being contiguous with a centrally extending center portion of said central edge of said wide end portion underside, said central edge running substantially along a center portion of said wide end portion underside, and said second side being formed from an incision through said wide end portion laterally spaced from said central edge, with said incision extending between longitudinal reinforcing lines stitched into said wide end portion;

a transverse member engaged for longitudinal sliding movements with said central portion of said longitudinal member; and button engaging means for releasably engaging said transverse member and a button of said shirt.

* * * * *